US006430846B1

(12) United States Patent
Lin

(10) Patent No.: US 6,430,846 B1
(45) Date of Patent: Aug. 13, 2002

(54) SHOE WITH DETACHABLE VAMP

(75) Inventor: Ghing-Yi Lin, Taichung Hsien (TW)

(73) Assignee: Gnan-Jang Plastics Co., Ltd. (TW)

( * ) Notice: Subject to any disclaimer, the term of this patent is extended or adjusted under 35 U.S.C. 154(b) by 0 days.

(21) Appl. No.: 09/903,525

(22) Filed: Jul. 13, 2001

(51) Int. Cl.[7] ..... A43B 3/12; A43B 3/24; A44B 11/26

(52) U.S. Cl. ..... 36/101; 36/11.5; 24/640

(58) Field of Search ..... 36/101, 100, 11.5, 36/15, 23; 24/640, 641, 591.1, 593.11, 594.1, 594.11, 596.1

(56) References Cited

U.S. PATENT DOCUMENTS 4,301,576 A * 11/1981 Cunningham ..... 24/640
4,377,887 A * 3/1983 Valestin ..... 24/596.1
4,715,096 A * 12/1987 Fleming et al. ..... 24/641
4,999,886 A * 3/1991 Kasai ..... 24/640
5,551,589 A * 9/1996 Nakamura ..... 220/326
5,896,684 A * 4/1999 Lin ..... 36/101

* cited by examiner

*Primary Examiner*—Anthony Stashick
(74) *Attorney, Agent, or Firm*—Bacon & Thomas, PLLC

(57) ABSTRACT

A shoe with a detachable vamp. The shoe includes a sole having a anchor seats encased by integral injection forming processes. Each anchor seat has a wedge slot with tow teethed elastic flaps located therein and a connecting flap bridging between the two elastic flaps. The anchor seat has a side wall adjacent to the wedge slot with a round opening formed on the side wall. The opening engages with a pushbutton through a strut which engages with an annular tenon at one end. Latch members are provided to stitch to a vamp and to engage with the anchor seats. Each latch member has two latch blades extended downwards and has teeth formed on one side corresponding to the teethed elastic flap.

3 Claims, 8 Drawing Sheets

SHOE WITH DETACHABLE VAMP

BACKGROUND OF THE INVENTION

The present invention relates to a shoe with a detachable vamp and particularly a shoe with a detachable vamp which may be removed and replaced rapidly and easily without using tools to create versatile alterations for a pair of shoes that are achievable only by owning a plurality of shoes.

A conventional shoe (as shown in FIG. 1) generally has a vamp 1 stitched to an insole 2 at a selected location thereof (with a stitching line 3 shown in FIG. 1), then the insole 2 is bonded to an outsole 4. The stitching work usually should be done by skilled workers and is labor intensive. It increasingly becomes a big burden to the producers in manpower deployment. Moreover, because of the curved shapes and surfaces of the shoes, it is difficult to increase the stitching speed. As a result, the fabrication process is slow and production costs become higher. In addition, the stitching lines tend to wear off and rupture easily. If the stitching work is not done properly, the stitching lines could be exposed or form uneven thread knots on the insole surface and make wearing the shoe uncomfortable. Once the vamp 1 is damaged, it is not replaceable. All this becomes great disadvantages.

Furthermore, the vamp 1 for conventional sandals and slippers is not changeable by users. To make the sandals and slippers with vamps 1 of different patterns and colors, many different pairs of shoes must be fabricated. It is not appealing to consumers.

Moreover, the producers have to prepare and setup many different molds. This will greatly increase the costs.

SUMMARY OF THE INVENTION

It is therefore an object of the present invention to provide a shoe with a detachable vamp which may be removed and replaced rapidly and easily without using tools to create versatile alterations for a pair of shoes that are achievable only by owning a plurality of shoes.

To attain the foregoing object, the present invention mainly includes a plurality of anchor seats formed by integral injection processing. Each anchor seat has a wedge slot which houses teethed elastic flaps and a connecting flap bridging two elastic flaps. The anchor seat has a side wall which has a round opening to wedge a pushbutton therein. The push button has a strut extended from one side and an annular tenon engaged at one end of the strut for engaging with the round opening securely. A plurality of latch members are provided to fasten a vamp. Each latch member has two latch blades extending downwards. The latch blade also has a teethed surface and may be inserted into the wedge slot to engage with the teethed elastic flap securely. By means of aforesaid construction, the vamp may be attached securely to the sole through the latch members. By pressing the pushbutton, the latch member may be released from the sole to detach the vamp. Hence users can easily change and replace the vamps of different styles and patterns without using any tool. And a pair of shoes may have many different alterations achievable only by many different pairs of conventional shoes.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
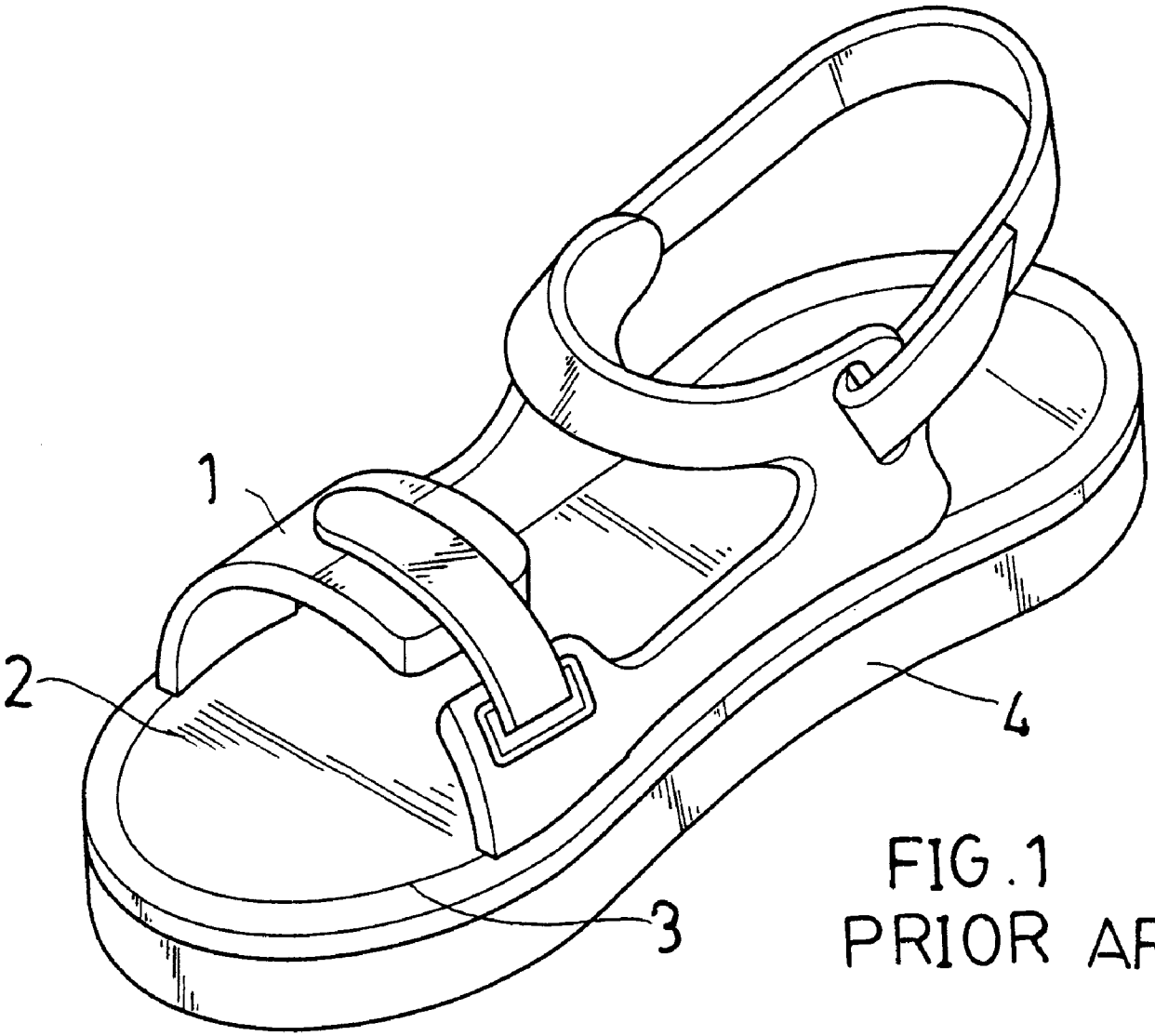
FIG. 1 PRIOR ART
FIG. 1 is a pictorial view of a sandal made by a conventional stitching method.
Figure 2:
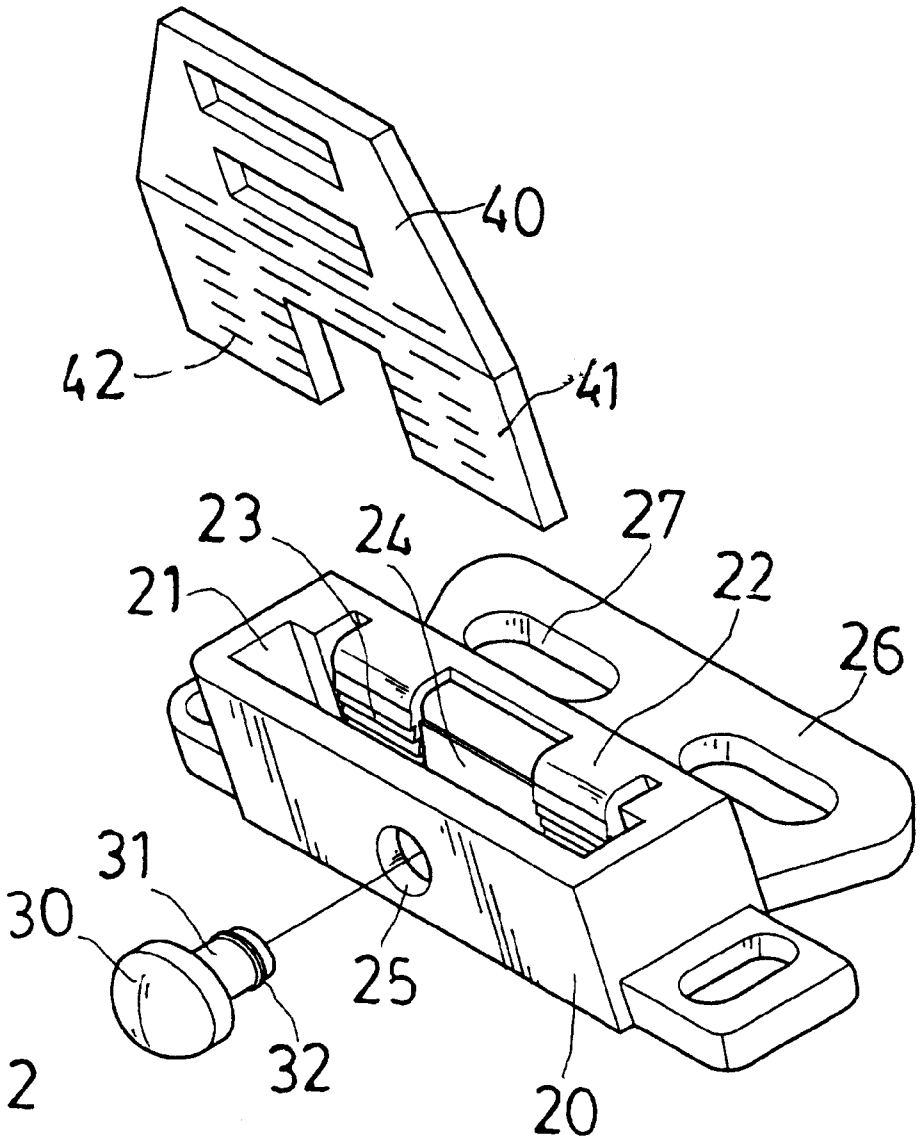
FIG. 2 is an exploded view of an anchor seat of the present invention.
Figure 3:
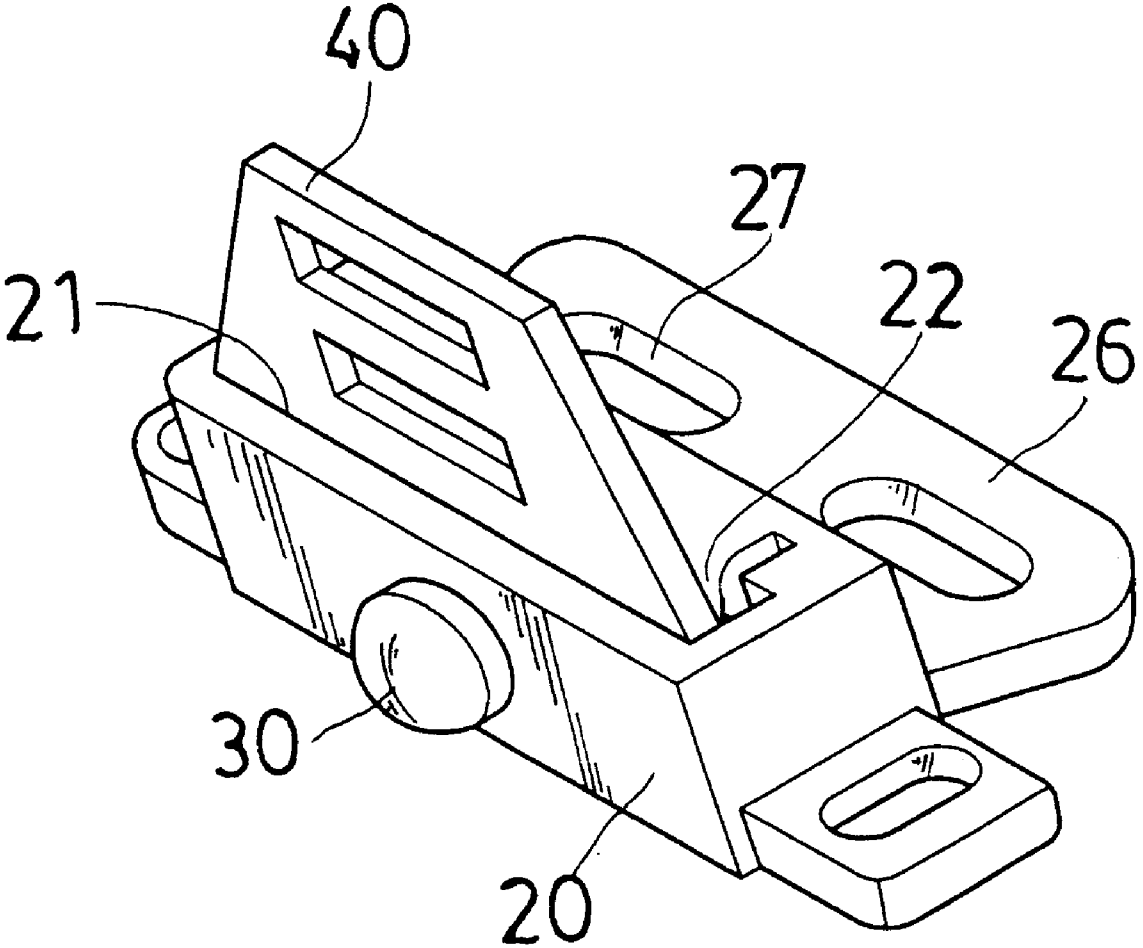
FIG. 3 is a perspective view of an anchor seat of the present invention.
Figure 4:
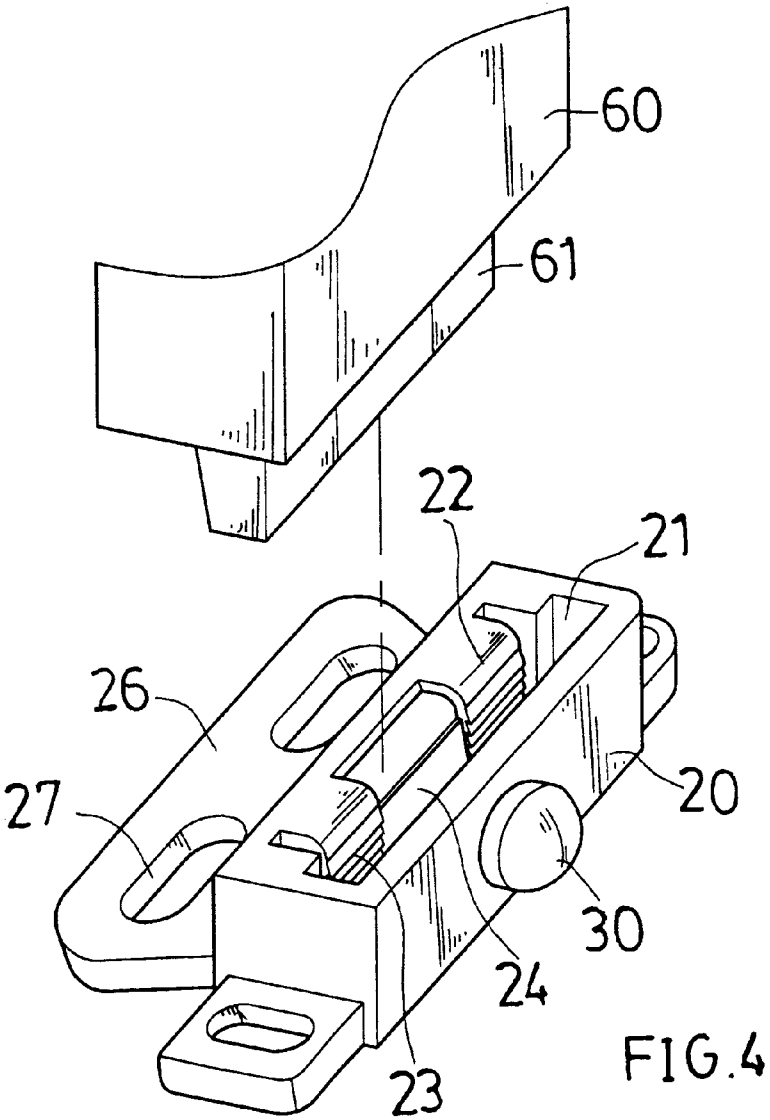
FIG. 4 is a schematic view of an anchor seat and a matching upper mold.

Referring to FIGS. 2 through 6C, the present invention mainly includes the following features in a shoe sole 10.

A plurality of anchor seats 20 which are made by integral injection forming, and each has a wedge slot 21 with an upward opening, two elastic flaps 22 located in the wedge slot 21 and extended vertically downwards, a connecting flap 24 bridged between the elastic flaps 22, a side opening 25 formed in a side wall of the wedge slot 21, a web 26 extended sidewards from the bottom of the anchor seat 20 and a plurality of apertures 27 formed in the web 26. Each elastic flap 22 has an outer side with first teeth 23 formed thereon. The web 26 and apertures 27 are used to increase the bonding strength when the anchor seat 20 is encased in the sole 10.

A plurality of pushbuttons 30 each is engageable with the side opening 25 of the anchor seat 20 and has a strut 31 extended from one side and an annular tenon 32 located proximately to one end of the strut 31. The strut 31 may be inserted into the side opening 25 and engages with the opening securely through the annular tenon 32 so that the pushbutton 30 once inserted into the opening 25 won't get loose or break away from the anchor seat 20.

A plurality of latch members 40 each has two latch blades 41 extended from the bottom thereof for engaging with the wedge slot 21 of the anchor seat 20 and corresponding to the elastic flaps 22. The latch blade 41 has a side surface with second teeth 42 formed thereon to engage with the first teeth 23 of the anchor seat 20. When assembling the foregoing elements on a shoe, stitch two latch members 40 at two ends of a vamp 50, insert the pushbutton 30 into the side opening 25 of the anchor seat 20 through the strut 31 and engage with the opening 25 securely by the tenon 32 to prevent the pushbutton 30 from breaking away from the opening 25.

Figure 5:
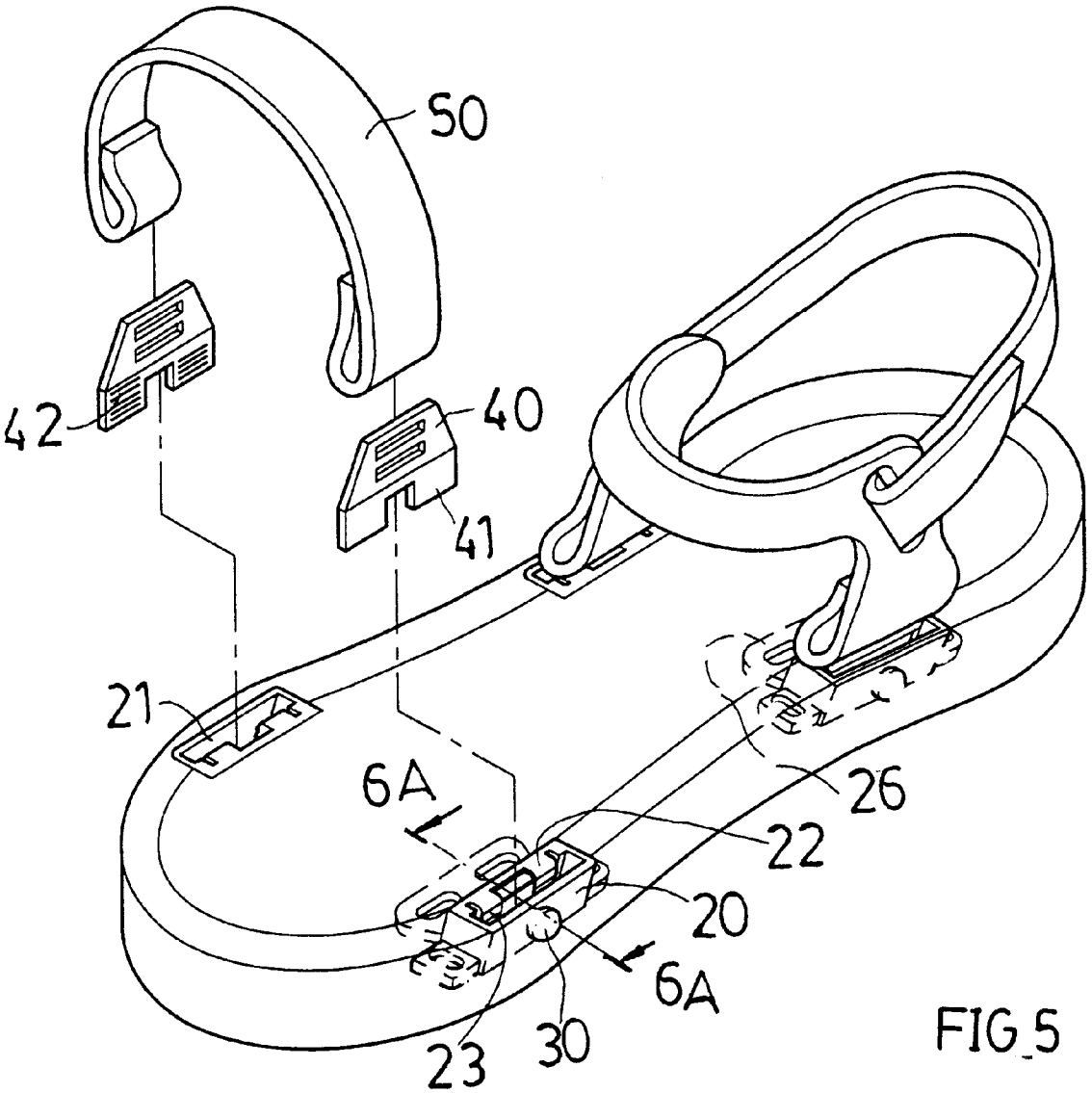
FIG. 5 is an exploded view of a sandal according to the invention.
Figure 6A:
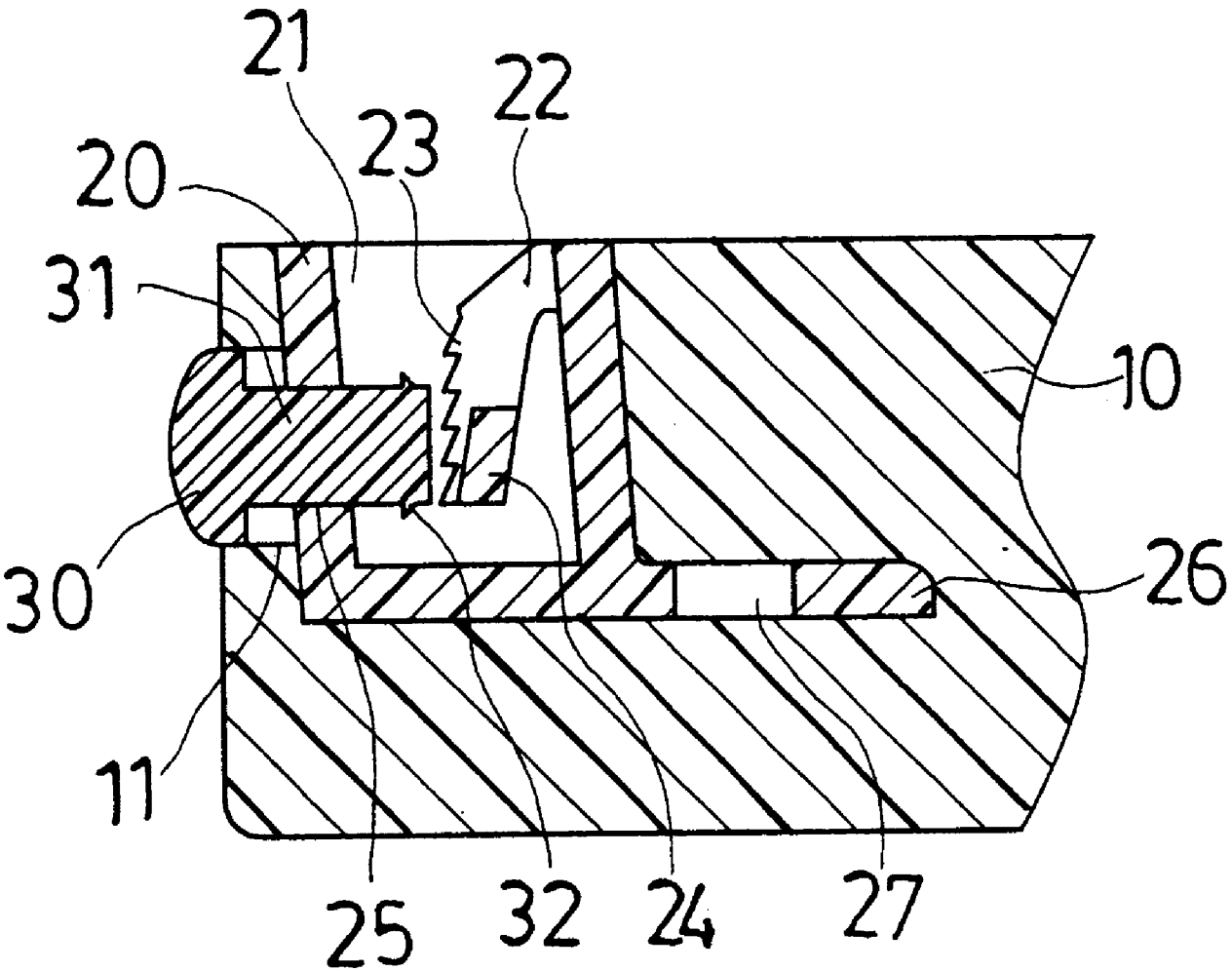
FIG. 6A is a fragmentary sectional view taken along line 6A—6A in FIG. 5.

To make the sole 10 of the invention, dispose a wedge tongue 61 in the mold 60 at a location corresponding to the position of the vamp 50 for engaging with the wedge slot 21 of the anchor seat 20, then employ injection forming process to inject foaming raw material into the mold 60 to form the sole 10. The anchor seats 20 are encased in the sole 10 at selected peripheral rims (as shown in FIGS. 5 and 6A). The head of the pushbutton 30 is exposed outside the opening 11 of the sole 10.

Figure 6B:
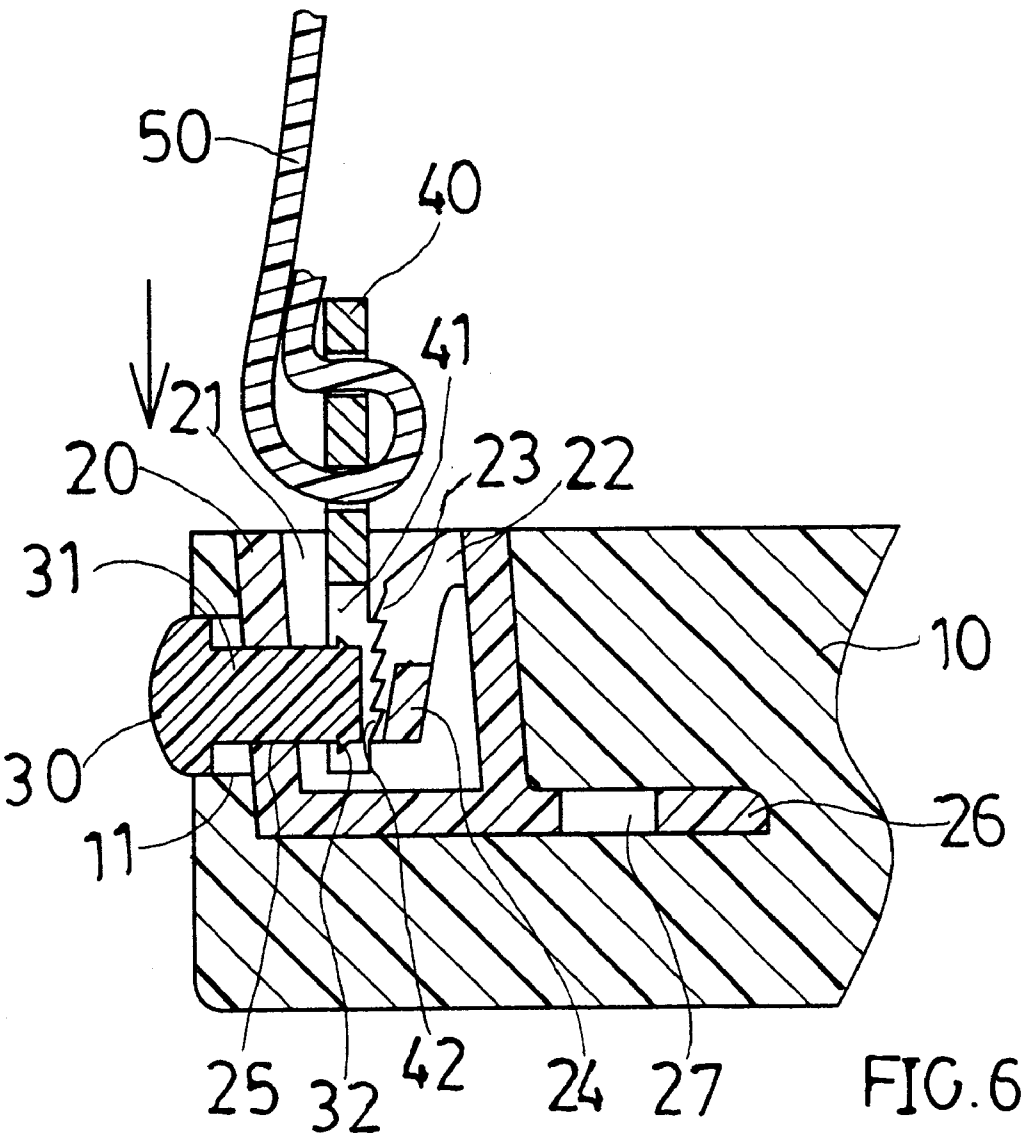
FIG. 6B is a fragmentary sectional view of inserting a latch member according to FIG. 6A.

When to assemble the vamp 50, engage the vamp 50 which has latch members 40 attached to thereon with the sole 10 by inserting the latch member 41 into the wedge slot 21 of the anchor seat 20, engage the second teeth 42 of the latch blade 41 with the first teeth 23 of the elastic flap 22 so that the latch member 40 will engage with the anchor seat 20 securely without separating. Then a completed shoe is assembled and finished without special skills. At this state, the strut 31 of the pushbutton 30 is extended between the two latch blades 41 of the latch member 40 (as shown in FIG. 6B). This is the regular and normal using condition.

Figure 6C:
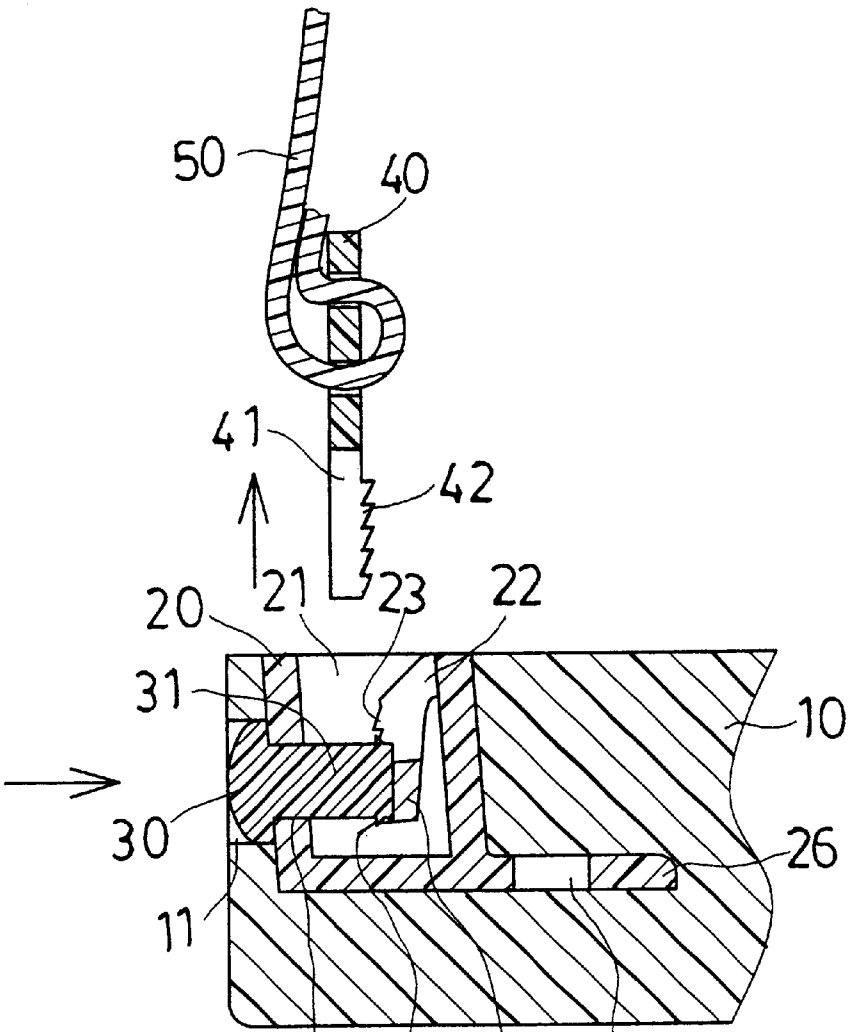
FIG. 6C s a fragmentary sectional view of removing a latch member according to FIG. 6A.

When there is a need or desire to change the vamp 50, press the pushbutton 30 located at the peripheral rim of the sole 10. As shown in FIG. 6C, when the pushbutton 30 is pressed, the strut 31 will be pushed inwards to press against the connecting flap 24. The connecting flap 24 will be moved inwards and also drags the elastic flaps 22 at two sides inwards. As a result, the first teeth 23 of the elastic flap 22 will be separated from the second teeth 42 of the latch blade 41. Hence the latch member 40 may be moved away from the wedge slot 21 freely for detaching the vamp 50 from the sole 10. Then another vamp 50 may be assembled to the sole 10 by the processes set forth above. I.E. to insert the latch blade 41 of the latch member 40 of the new vamp 50 into the wedge slot 21 of the anchor seat 20, and to make the first teeth 23 of the elastic flap 22 engaging with the second teeth 42 of the latch blade 41. The new vamp 5 thus may be fastened to the sole 10 securely.

The construction of the invention set forth above has the following advantages:

1. The anchor seats 20 and pushbuttons 30 are encased in the sole 10. Hence assembly and replacement may be accomplished easily and rapidly by pressing the pushbuttons 30 without using any tool. Various alterations and changes may be made to a pair of shoes to achieve the effects of owning several pairs of shoes at the same time.
2. The anchor seats 20 are encased in the sole 10 without exposure. Only the heads of the pushbuttons 30 are exposed to the peripheral rim of the sole 10. Thus the overall appearance of the shoes may be kept intact.
3. The anchor seat 20 has an extended web 26 and apertures 27 which can enhance the bonding strength of the anchor seat 20 when embedding in the sole 10.
4. Change and replacement of the vamp 50 is very simple. Consumers can change different types of vamps 50 by themselves whenever desired.
5. As the vamp 50 is detachable and replaceable, producers need only to prepare and setup one set of mold 60 to produce the sole 10. It can save production cost.

What is claimed is:

1. A shoe with a detachable vamp, comprising:

a plurality of anchor seats, each of the anchor seats having a wedge slot and two elastic flaps extended vertically downwards in the wedge slot, each elastic flap having an outside surface with first teeth formed thereon;

a plurality of latch members each having two latch blades extended downwards matching the elastic flaps of the anchor seat, each latch blade having a side surface with second teeth formed thereon corresponding to and engageable with the first teeth of the anchor seat; and wherein the anchor seat further has a connecting flap bridging the two elastic flaps.

2. The shoe with detachable vamp of claim 1, wherein the anchor seat has a side wall adjacent to the wedge slot, the side wall having a through round opening formed thereon to engage with a pushbutton.

3. The shoe with detachable vamp of claim 2, wherein the pushbutton has a strut extended from one side thereof insertable into the round opening and an annular tenon proximate one end of the strut.

* * * * *